United States Patent [19]

Fitzgerald et al.

[11] 4,022,623

[45] May 10, 1977

[54] PHOTOSENSITIVE EMULSION CONTAINING POLYVINYL AMINIMIDE POLYMERS

[75] Inventors: Maurice J. Fitzgerald, Canton; Henry S. Kolesinski, Burlington; Lloyd D. Taylor, Lexington, all of Mass.

[73] Assignee: Polaroid Corporation, Cambridge, Mass.

[22] Filed: Oct. 28, 1975

[21] Appl. No.: 626,214

[52] U.S. Cl. ..... 96/114; 96/57; 96/84 A

[51] Int. Cl.[2] ..... G03C 1/72

[58] Field of Search ..... 96/57, 84 A, 114

[56] References Cited

UNITED STATES PATENTS

| | | | |
|---|---|---|---|
| 3,641,145 | 2/1972 | Culbertson et al. | 260/558 |
| 3,859,096 | 1/1975 | Burness et al. | 96/114 |
| 3,879,205 | 4/1975 | Fitzgerald et al. | 96/114 |
| 3,925,083 | 12/1975 | Fitzgerald | 96/114 |

*Primary Examiner*—Jack P. Brammer
*Attorney, Agent, or Firm*—P. G. Kiely

[57] ABSTRACT

A photosensitive silver halide emulsion wherein the emulsion binder comprises a polyvinyl aminimide polymer or copolymer.

8 Claims, 1 Drawing Figure

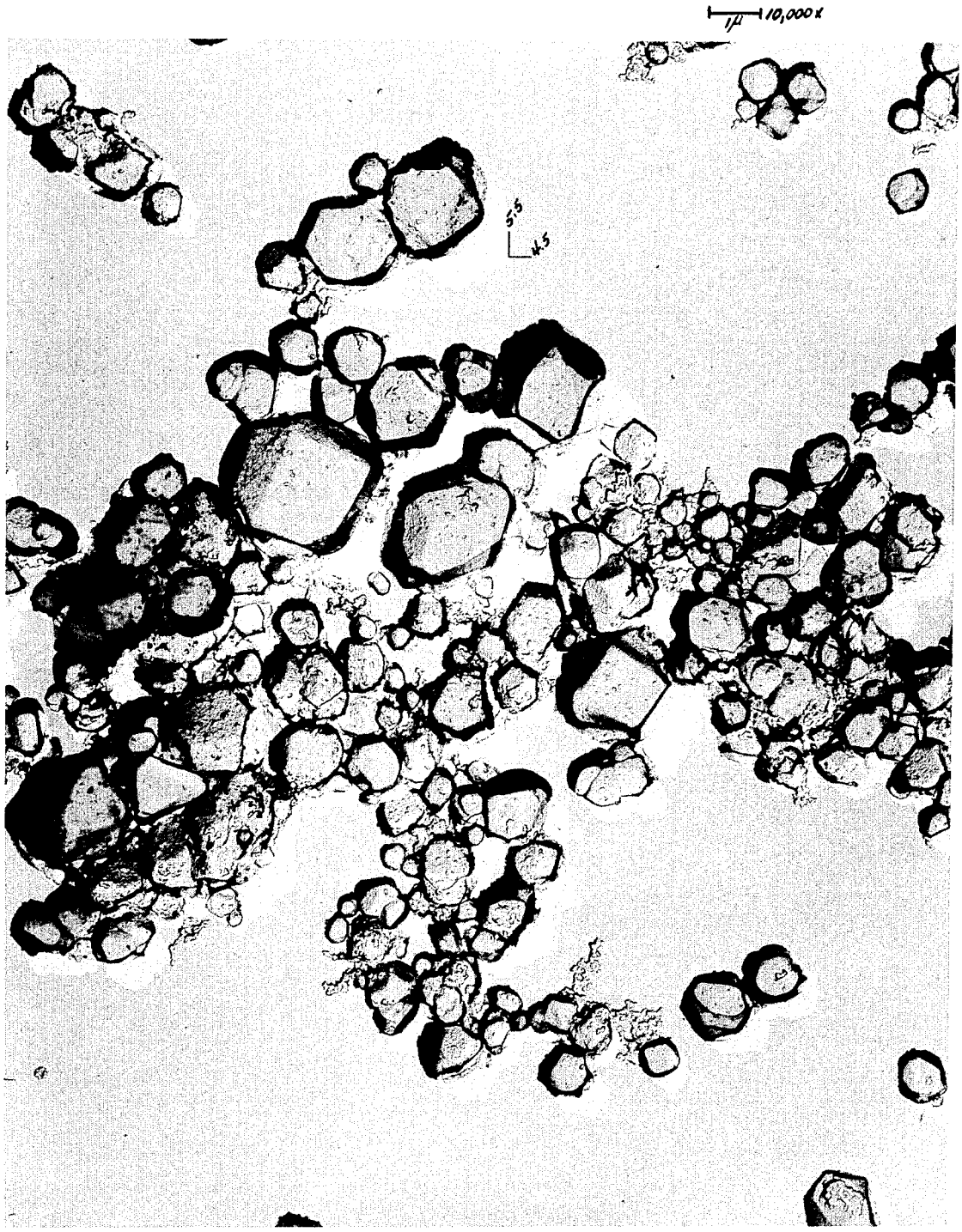
1μ
10,000x
5.5
4.5

PHOTOSENSITIVE EMULSION CONTAINING POLYVINYL AMINIMIDE POLYMERS

BACKGROUND OF THE INVENTION

This invention relates to photography and more particularly, to novel photosensitive photographic elements, particularly novel photosensitive emulsions.

As a result of the known disadvantages of gelatin, in particular, its variable photographic properties and its fixed physical properties, for example, its diffusion characteristics, much effort has been expended in the past in order to replace gelatin with a suitable synthetic colloid binder for photographic silver halide emulsions. Many snythetic polymeric materials have heretofore been suggested as peptizers for silver halide emulsions, however, these have generally not functioned satisfactorily and frequently have not fulfilled all of the basic requirements for a photosensitive silver halide emulsion binder listed following:

1. absent (or constant) photographic activity;
2. ability to form an adsorption layer on microcrystals of silver halide permitting stable suspensions to be obtained;
3. ability to form adsorption layers as described in (2) above which do not prevent growth of silver halide microcrystals during physical ripening; and
4. solubility in water solution.

In addition, hithertofore, much emphasis has been placed on the ability of the synthetic polymeric material to mix with gelatin, as this property has been critical for employment in partial substitution reactions with gelatin. Consequently, many synthetic polymers of the prior art have been materials which allow for the growth of silver halide crystals only in the presence of gelatin.

Certain bis-aminimide compounds have been described in the photograhic art as being useful anti-static agents when included in light-sensitive silver halide photograhic materials. See, for example, U.S. Pat. No. 3,811,887. These compounds, how ever, are readily distinguished over the polymeric aminimide compounds of the present invention. Copending application Ser. No. 537,123, filed in the name of Kolesinski et al on Dec. 30, 1974, discloses the use of polyvinyl aminimide compounds as the viscosity increasing component of a diffusion transfer porcessing composition. Silver halide emulsions employing such polyvinyl aminimide polymers as an emulsion binder, however, have hithertofore been unknown to the art.

SUMMARY OF THE INVENTION

The present invention is directed to a photosensitive silver halide emulsion wherein the silver halide crystals are disposed in a synthetic binder comprising a water soluble film-forming polyvinyl aminimide polymer or copolymer having in its structure repeating units represented by the formula:

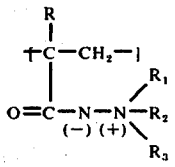

wherein R is hydrogen, alkyl or halogen; $R_1$ is alkyl; $R_2$ and $R_3$ each are alkyl, aryl or alkaryl or $R_2$ and $R_3$ may be taken together to form a heterocyclic ring with the nitrogen. It is recognized that at low pH on the acid side, the aminimide converts to a cationic hydrazinium-salt and that this conversion is reversible and may be represented as follows:

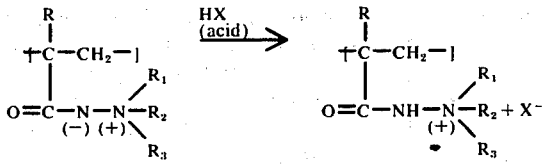

Therefore, the term "polyvinyl aminimide", as used herein, is also intended to include the aminimide form, the hydrazinium form and mixtures thereof.

BRIEF DESCRIPTION OF THE FIGURE

The FIG. is a reproduction of an electron photomicrograph of a silver halide emulsion of the present invention.

DETAILED DESCRIPTION OF THE INVENTION

As indicated, the present invention is directed to photosensitive silver halide emulsions wherein photosensitive silver halide crystals are disposed in a synthetic binder comprising a water-soluble film-forming polyvinyl aminimide polymer or copolymer having in its structure repeating units represented by the formula set forth above. The term "film-forming" is intended to designate a molecular weight sufficiently high to form a film. for example, a molecular weight comparable to that of gelatin (i.e., around 15,000).

Such polymers have been found to substantially meet all the basic requirements for a gelatin substitute without possesing the deficiencies of gelatin as delineated above. The emulsions of the present invention are more stable against degradation than gelatin; particularly against hydrolysis of the polymeric backbone in basic media.

As examples of suitable polyvinyl aminimides suitable for use in the present invention, mention may be made of the following:

1.

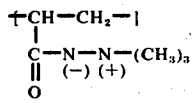

2.

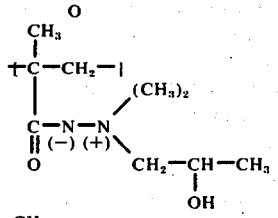

3.

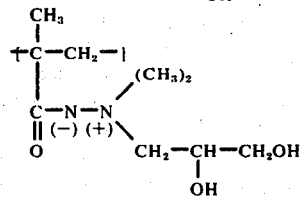

4.

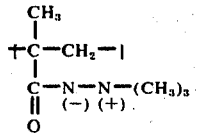

The polyvinyl aminimides of the present invention are known to the art. Aminimides suitable for use in the present invention are prepared by reacting a hydrazine with the appropriate vinyl acid chloride. Polymerization may be achieved by free radical polymerization techniques. Additional details regarding preparation of the monomers and formation of the polymers may be found in U. S. Pat. No. 3,641,145, issued Feb. 8, 1972, incorporated by reference herein in its entirety.

The above-described aminimides may be copolymerized with suitable ethylinically unsaturated monomers known to the art provided that the comonomer is not photographically detrimental.

The following nonlimiting example illustrates the preparation of a representative polymer:

EXAMPLE I

The following materials were placed in a glass vessel:

| | Parts by Weight |
|---|---|
| $CH_2{=}CH{-}\overset{O}{\overset{\|}{C}}{-}\underset{(-)}{N}{-}\underset{(+)}{N}{-}(CH_3)_3$ | 1 |
| Water | 9 |
| Azobisisobutyronitrile | 0.001 |

The vessel was flushed with nitrogen, evacuated and sealed under a vacuum. After heating at 65 degrees C. overnight, the polymer, poly-1,1,1-trimethylamine acrylimide, was precipitated into acetone, filtered and dried.

The following general procedure may be used for preparing photographic emulsions using the above-described polymers of the instant invention as the colloid binder.

A water-soluble silver salt, such as silver nitrate, may be reacted with at least one water-soluble halide, such as potassium, sodium, or ammonium bromide, preferably together with potassium, sodium or ammonium iodide, in an aqueous solution of the polymer. The emulsion of silver halide thus-formed contains water-soluble salts, as a by-product of the double decomposition reaction, in addition to any unreacted excess of the initial salts. To remove these soluble materials, the emulsion may be centrifuged and washed with distilled water to a low conductance. The emulsion may then be redispersed in distilled water. To an aliquot of this emulsion may be added a known quantity of a solution of bodying or thickening polymer, such as polyvinly alcohol having an average molecular weight of about 100,000 (commercially available from E. I. duPont deNemours & Company, Wilmington, Delaware, designated Type 72–60). A surfactant, such as dioctyl ester of sodium sulfosuccinic acid, designated Aerosol OT, (commerically available from American Cyanamid Company, New York, New York), may be added and the emulsion coated onto a film base of cellulose triacetate sheet having a coating of hardened gelatin.

Alternatively, the soluble salts may be removed by adding to the emulsion a solution of polyacid, such as 1:1 ethylene: maleic acid copolymer, and lowering the pH to below 5, thereby bringing about precipitation of the polyacid carrying the silver halide grains along with the precipitate. The resulting precipitate may then be washed and presuspended by redissolving the polyacid at pH 6–7.

The emulsions may be chemically sensitized with sulfur compounds such as sodium thiusulfate or thiourea, with reducing substances such as stannous chloride; with salts of noble metals such as gold, rhodium and platinum; with amines and polyamines; with quaternary ammonium compounds such as alkyl $\alpha$-picolinium bromide; and with polyethylene glycols and derivitives thereof.

The emulsions of the present invention may also be optically sensitized with cyanine and merocyanine dyes. Where desired, suitable antifoggants, toners, restrainers, developers, accelerators, preservatives, coating aids, plasticizers, hardeners and/or stabilizers may be included in the composition of the emulsion.

The emulsions of this invention may be coated and processed according to conventional procedures of the art. They may be coated, for example, onto various types of rigid or flexible supports,, such as glass, paper, metal, and polymeric films of both the synthetic type and those derived from naturally occurring products. As examples of specific materials which may serve as supports, mention may be made of paper, aluminum, polymethacrylic acid, methyl and ethyl esters, vinylchloride polymers, polyvinyl acetal, polyamides such as nylon, polyesters such as polymeric film derived from ethylene glycol-terephthalic acid, and cellulose derivatives such as cellulose acetate, treactate, nitrate, propionate, butyrate, acetate propionate, and acetate butyrate. Suitable subcoats may be provided on the supports, for example a layer of gelatin, if necessary or desirable for adherence, as is well known in the art.

The preparation of a photographic silver halide emulsions employing a polyvinyl aminimide of the present invention is further illustrated by the following nonlimiting examples.

EXAMPLE II

A solution of about 2.08 g. of dry poly-1,1,1-trimethylamine acrylimide as prepared in Example I above, in 133 ml. of distilled water was adjusted to pH 3.0 with dilute nitric acid and maintained at a temperature of 55° C. To this solution, 22.0 g. of dry potassium bromide and 0.25 g of dry potassium iodide were added with stirring.

A solution of 27.5 g. of silver nitrate in 250 ml. of distilled water was prepared. About 92.8 gms of this silver nitrate solution was added with continuous agitation to the polymer-halide solution and the remainder was added in two 92.8 gm quantities after 30 minutes and 60 minutes respectively. Total stirring time was 90 minutes. Thereafter, the emulsion was ripened for 30 minutes at 55° C., and then rapidly cooled to below 20° C.

EXAMPLE III

The procedure of Example II was essentially repeated with poly-1,1-dimethyl-1-(2-hydroxy propyl) amine methacrylimide as the binder polymer instead of poly-1,1,1-trimethylamine acrylimide, except that the pH of the polymer solution was adjusted to 6.3 instead of 3.0 before the halide was added.

The attached FIG. is an electron photomicrograph of the resultant emulsion of Example III at 10,000 X showing the silver halide grains which were grown in the polyvinyl animinide binder of the present invention.

Photographic utilization of the silver halide emulsions may be demonstrated by the following representative procedure:

The emulsion mixture of either of the above examples may be centrifuged and washed with water to a low conductance to remove soluble impurites and by-products. The emulsion may then be redispersed in distilled water. To an aliquot of this emulsion, a known quantity of a solution of bodying or thickening polymer, e.g. gelatin or polyvinyl alcohol, may be added to give the desired silver to polymer ratio. A surfactant, e.g. a dioctyl ester of sodium sulfosuccinic acid (Aerosol OT , American Cyanamid Co.) may be added and the emulsion slot-coated at the desired silver coverage onto a base of cellulose triacetate sheet 5 mils thick subcoated with about 30 mg. per square foot of hardened gelatin. The film so prepared may then be air dried, exposed on a sensitometer and processed with a processing solution and image receiving sheet from a conventional silver diffusion transfer film unit of the type sold by Polaroid Corporation, Cambridge, Mass. The negative and image-receiving element may be maintained in superposed position for the required imbibition time, eg. 10–15 seconds, after which they may be stripped apart. The photograhic characteristics of the resulting positive print may then be measured on a densitometer and evaluated.

In certain photograhic applications, it may be desirable to replace part, but not all, of the gelatin in the photosensitive emulsion. In view of the characteristics of these polymers described above, and further, in view of their compatability with gelatin in substantially all proportions, it will be obvious that these polymers are ideally suited for such use.

The term "photosensitive" and other terms of similar import are herein empolyed in the generic sense to describe materials possessing physical and chemical properties which enable them to form usable images when photoexposed by radiation actinic to silver halide.

Since certain changes may be made in the above products and processes without departing from the scope of the invention herein involved, it is intended that all matter contained in the above description shall be interpreted as illustrative only and not in a limiting sense.

What is claimed is:

1. A photosensitive silver halide emulsion containing an emulsion binder wherein the emulsion binder consists essentially of a water-soluble film-forming polyvinyl aminimide polymer havingin its structure repeating units of the formula:

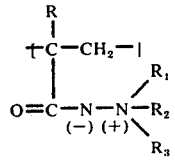

wherein R is hydrogen, alkyl or halogen; $R_1$ is alkyl; $R_2$ and $R_3$ each are alkyl, aryl or alkaryl or $R_2$ and $R_3$ may be taken together to form a heterocyclic ring with the nitrogen.

2. The product of claim 1 wherein said silver halide emulsion is a silver iodobromide emulsion.

3. The product of claim 1 wherein said polymer is poly-1,1,1-trimethylamine acrylimide.

4. The product of claim 1 wherein said polymer is poly-1,1-dimethyl-1-(2-hydroxypropyl) amine methacrylimide.

5. A method of preparing a photosensitive silver halide emulsion which comprises reacting a water-soluble silver salt with a water-soluble halide salt in an aqueous solution containing a water-soluble film-forming binder polymer consisting essentially of a polyvinyl aminimide polymer having in its structure repeating units of the formula:

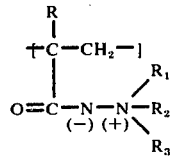

wherein R is hydrogen, alkyl or halogen; $R_1$ is alkyl; $R_2$ and $R_3$ each are alkyl, aryl or alkaryl or $R_2$ and $R_3$ may be taken together to form a heterocyclic ring with the nitrogen.

6. A method as defined in claim 5 wherein said polymer is poly-1,1,1-trimethylamine acrylimide.

7. A method as defined in claim 5 wherein said polymer is poly-1,1-dimethyl-1-(2-hydroxypropyl) amine methacrylimide.

8. The method as defined in claim 5 which further comprises:

precipitating silver halide from said emulsion;

removing soluble by-products from said silver halide; and redispersing said silver halide in a solution containing a bodying polymer.

* * * * *